US006173555B1

(12) United States Patent
Jaeger et al.

(10) Patent No.: US 6,173,555 B1
(45) Date of Patent: Jan. 16, 2001

(54) METHOD OF FEEDING FLAT SAMPLE BAGS INTO PROCESSING

(75) Inventors: Erich Jaeger, Frauenfeld; Markus Scheuber, Weisslingen, both of (SE)

(73) Assignee: Ferag AG, Hinwil (CH)

( * ) Notice: Under 35 U.S.C. 154(b), the term of this patent shall be extended for 0 days.

(21) Appl. No.: 09/457,919

(22) Filed: Dec. 9, 1999

Related U.S. Application Data

(62) Division of application No. 09/075,543, filed on May 11, 1998, now Pat. No. 6,029,819.

(30) Foreign Application Priority Data

May 14, 1997 (SE) ..... 0112797

(51) Int. Cl.[7] ..... B65B 5/10; B65B 63/04
(52) U.S. Cl. ..... 53/429; 53/447; 53/467
(58) Field of Search ..... 53/429, 447, 467; 206/494, 39.8, 499, 554, 820

(56) References Cited

U.S. PATENT DOCUMENTS

| | | | |
|---|---|---|---|
| 2,650,703 | 9/1953 | Hagen | 206/59 |
| 3,285,405 | 11/1966 | Wanderer | 206/56 |
| 4,201,029 | 5/1980 | Lerner et al. | 53/429 |
| 4,416,376 | 11/1983 | Scheffers et al. | 206/554 |
| 4,458,814 | 7/1984 | Meschi | 206/494 |
| 5,036,977 | 8/1991 | Schofield et al. | 206/389 |
| 5,956,926 * | 9/1999 | O'Connor | 53/429 |

* cited by examiner

*Primary Examiner*—John Sipos
(74) *Attorney, Agent, or Firm*—Pearne & Gordon LLP

(57) ABSTRACT

Discrete lengths of a web (1) of sample bags are each arranged in a container in an ordered manner such that each web can be removed from its container (13) without additional aids by pulling on a head end (A) of the web length, and so that the tail end (E) of each such web length can also be gripped without changing the web arrangement in the container and independently of the fullness of the container. For feeding sample bags into a processing station, a first container is positioned in the region of the feeding location and the head end (A) of the web length is pulled out of its container and led to a feeding mechanism of the processing station. During the feeding of the first web length of bags into the processing, further containers are formed into a series of containers by connecting the tail end (E) of the web in one container to the head end (A) of a web length in the following container. Webs of bags arranged as a plurality of folded stacks in each container permit sequential feeding of the bags to high-speed processing equipment. Parallelepipedic boxes are especially suitable for this purpose.

5 Claims, 5 Drawing Sheets

Fig.5
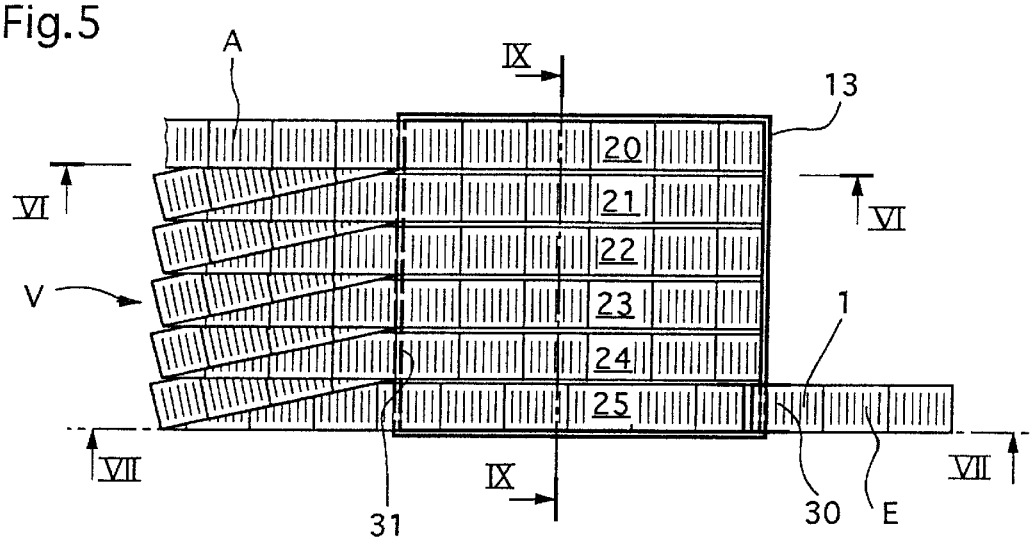
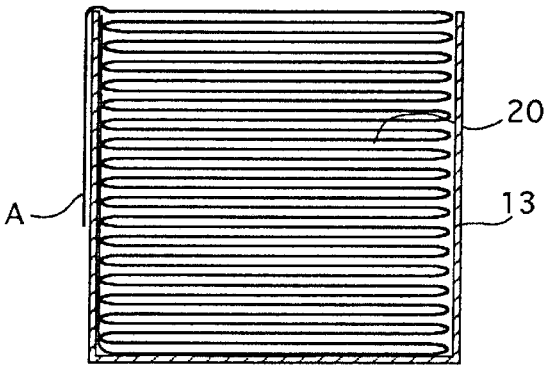
Fig.6
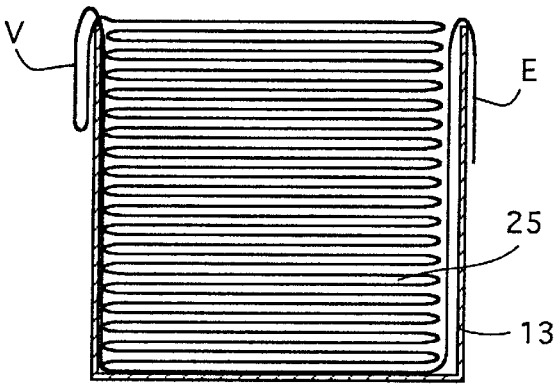
Fig.7
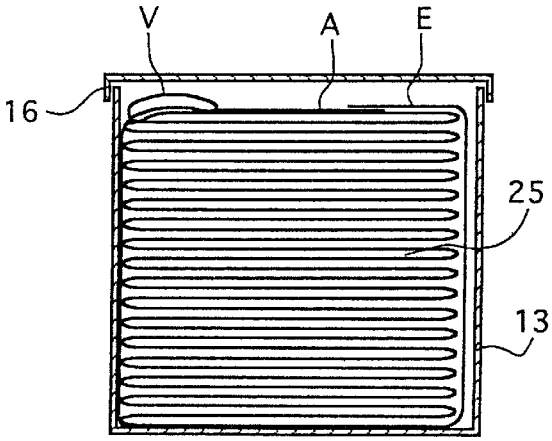
Fig.8
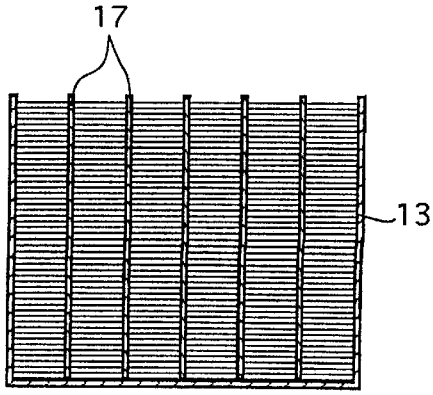
Fig.9

METHOD OF FEEDING FLAT SAMPLE BAGS INTO PROCESSING

CROSS REFERENCE TO RELATED APPLICATION

This is a division of application Ser. No. 09/075,543 filed May 11, 1998, now U.S. Pat. No. 6,028,819.

FIELD OF THE INVENTION

This invention concerns a method for feeding flat sample bags into further processing. The invention further concerns an arrangement of a web of flat sample bags as an intermediate product of the aforementioned inventive method.

BACKGROUND OF THE INVENTION

Flat sample bags are to be understood as, e.g., bags which consist of two pieces of a film material welded together on all sides or of one folded such piece welded together on three sides, Such sample bags are usually filled with liquid, pasty or powdery contents or contain solid, more or less flat objects. This kind of sample bag is mostly produced from two quasi-endless webs of film-type material wherein the webs are guided against each other and are welded together along their longitudinal edges. At the same time, the webs are welded together transversely at regular intervals and the bags thus produced are filled between the steps of transverse welding. It is also possible for only one web of film-type material to be used, the web being folded parallel with its longitudinal edges and the two longitudinal edges are welded to form a welded edge opposite the folded edge. In both cases, a web of sample bags is formed which is then separated into individual sample bags.

Flat sample bags of the kind described above are often further processed by supplying them into the continuous processing of other objects to be added to the latter in any manner. For example, the sample bags may be laid or glued into printed products or they may be added to the packing of other objects or introduced into envelopes together with printed matter.

For the automatic feeding of the described sample bags into further processing with a high throughput, the sample bags are, e.g., filled into suitable boxes in which they are arranged in the form of a horizontal stack. In publication EP-0 706 967 (or U.S. Pat. No. 5 601 396), a method for handling sample bags ordered in this manner is described. However, it shows that further measures are necessary if feeding speeds of 40,000 to 60,000 bags per hour are to be achieved, i.e., speeds which are, e.g., usual in the processing of printed products into which sample bags are to be glued.

Such further measures are proposed in the publication EP-739 822. These measures are based on the finding that the problems occurring when handling the bags at high speed are caused by the fact that the bags do not have a stable form and thus are difficult to grip. In the above publication, it is suggested that the form of the bags be changed such that it is more precisely defined and such that the bags can be stacked more easily.

It is also known not to separate the sample bags from each other and to feed them into further processing in the form of a web of sample bags. For this purpose, discrete lengths of a web of sample bags are rolled up to form, e.g., rolls which are positioned on suitable unwinding devices for feeding. It is known also to produce and feed the web of sample bags quasi on-line by transporting the web to the feeding location in hanging loops and, if necessary, buffering the web in this form between production and further processing. In these methods, the bags do not need to be gripped individually and therefore high feeding performances can be achieved. This advantage, however, must be paid for with considerable additional cost for additional apparatus. Methods for feeding webs of sample bags are, e.g., described in the publications EP-0 292 891 (or U.S. Pat. No. 4 901 935) and EP-0 253 959 (or U.S. Pat. No. 4 841 714).

SUMMARY OF THE INVENTION

An object of the present invention is to provide a method with which the advantages of the different known methods for feeding flat sample bags into further processing can be combined or with which their disadvantages can be eliminated, respectively. With the inventive method, it is possible to feed flat sample bags into further processing with simple means and at very high feeding speeds.

The basic idea of the inventive method is to accommodate a discrete length of a web of sample bags in a container arranged such that a head end of the web can be gripped at any time, independently of the fullness of the container, and that the web can be pulled out of the container in an ordered manner without further aids by pulling on this head end. In order that the discrete lengths of webs in different containers can be connected to each other and prepared for feeding, it is advantageous if the tail end of the web in each container can be gripped also at any time independent of the fullness of the container and without changing the web arrangement in the container.

With webs of bags which are arranged in a container as a plurality of folded stacks or of arrangements similar to folded stacks, the features presented above can be implemented in the most simple manner. Containers which are especially suited for the method are, e.g., cardboard boxes each shaped like a parallelepiped.

For feeding the web into further processing, a first container is positioned in the region of the feeding location. Then the head end of the web is pulled out of the container and guided into a feeding mechanism. The feeding mechanism comprises guide means and drive means with which the web of bags is moved and it comprises separating means with which each foremost bag of the fed web of bags is separated from the web (it is also possible for a group of bags to be separated and processed together). Guide means and drive means grip the web, e.g., along its longitudinal edges.

In order to avoid the necessity of having to introduce the head end of each discrete length of web into the feeding mechanism, the tail end of such a discrete length of web, which, as mentioned above, can also be gripped, even when the container is completely full, is connected to the head end of the web in a succeeding container. This method step can be carried out with the simplest means (e.g., with adhesive tape), e.g., manually and at any time during feeding from the first container. In this manner a series of containers is created from which, during processing, empty ones are removed in front and to which full ones are connected in the back.

The advantage of the inventive method compared to known methods in which individual sample bags are processed is the fact that it is not necessary to grip individual bags, i.e., because the method step in which the not clearly defined form of the bags limits the feeding speed is eliminated. The expenditure for arranging the web of bags in the container is about the same as the expenditure for arranging individual bags in stacks.

The advantage of the inventive method, compared to known feeding methods in which webs of bags are fed, is the fact that no devices which would make the method more costly are required apart from the containers which are advantageously simple cardboard boxes. For this reason the inventive method, without any kind of adaptation, is advantageous for feeding bags into highly complex devices for high performance processing as well as being advantageous for feeding into the most simple devices with considerably smaller processing performances.

BRIEF DESCRIPTION OF THE DRAWINGS

The inventive method will be described more in detail in connection with the following drawings wherein:

FIG. 5 is a schematic top plan view of a first embodiment of an arrangement of folded stacks in a container in accordance with the inventive method;

FIGS. 6–8 are schematic side elevations, in section along lines VI—VI, VII—VII and IX—IX, respectively, of the embodiment of FIG. 5;

FIG. 9 is a schematic end elevation, in section, of the embodiment of FIGS. 5–8;

DETAILED DESCRIPTION OF PREFERRED EMBODIMENTS

Figure 1:
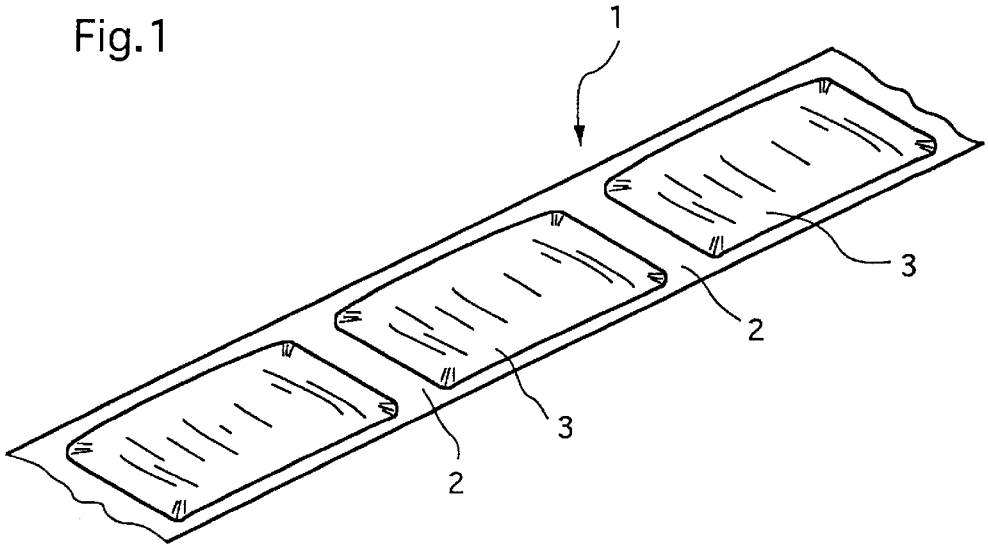
FIG. 1 is a schematic perspective view of a web of sample bags as used in the inventive method.

FIG. 1 shows a web of bags 1 as handled in accordance with the inventive method. This web is a flat tube divided into individual bags 3 by transverse weld zones 2. The individual bags created by transverse welding are filled with any contents which have a flat form or can be made to have a flat form. This kind of web 1 of bags is fed into further processing in which each bag to be processed is separated from the head end of the web immediately before it is further processed.

Figure 2:
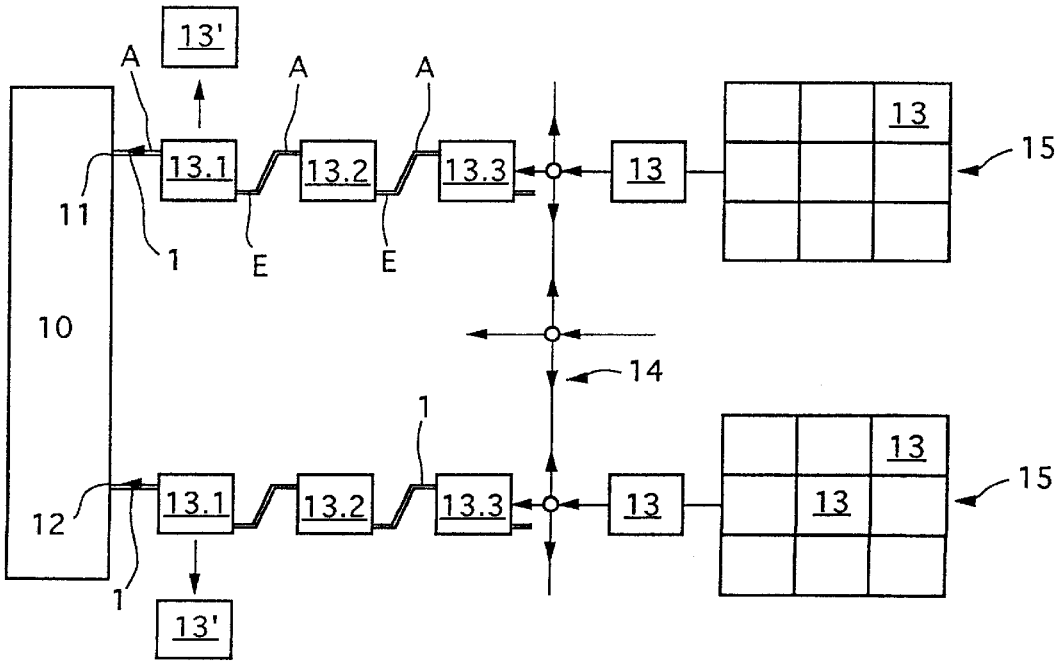
FIG. 2 is a schematic block diagram of an installation with feeding of sample bags for illustrating the functional principle of the inventive method.

To illustrate the inventive method, FIG. 2 shows a top view of an installation which is shown very schematically. The installation comprises a processing station 10, e.g., a processing drum or a linear processing device in which, e.g., bound or stitched, multi-page printed products are produced from printed product parts. The processing station is supplied with sample bags in the form of webs 1 of bags, e.g., by two feeding locations 11 and 12.

The two webs of bags to be fed to the processing station each have the form of a series of containers 13.1 to 13.3 each containing a discrete length of the web of bags. The head ends A and tail ends E of the discrete lengths of web protrude from the containers. Head end A of the web of bags of foremost container 13.1 of the series leads into processing station 10 and tail end E of each web of bags is connected to head end A of the web of bags in the succeeding container. Containers 13.1 to 13.3 are filled with the same or (e.g., for regionalized production) with different bags.

During processing, the two webs of bags are conveyed into the processing station by guide means and drive means which are not shown and for this purpose they are pulled out of the first container and then out of the succeeding containers.

The series of containers 13.1 to 13.3 is, e.g., arranged on a (not shown) conveyor belt which, after removal of an empty container 13', is activated such that a further container can be added to the series at its rear end. Behind the series of containers, which advantageously consists of two or more containers, a container distribution station 14 may be provided which is, e.g., equipped with a manual crane and which is shown schematically by circles and arrows. Full containers 13 are, e.g., loaded into distribution station 14 from pallets 15 and are added to one of the series of containers through distribution station 14.

Container contents of, e.g., 6,000 bags having each a size of 6×10 cm and a weight of ca. 5 g lead to a container size, e.g., in the order of 80×40×50 cm and a container weight in the order of 30 kg (plus the weight of the empty container). Such containers can be handled with simple means.

With a feeding speed of, e.g., 40,000 bags per hour a container as described above lasts for 9 minutes. This means that for the installation shown in FIG. 2 with two of three feeding locations in operation, per hour an average of 13 to 14 containers are to be connected to the series and the same amount of empty containers are to be removed. This results in an amount of work which can easily be carried out by one person.

Figure 3:
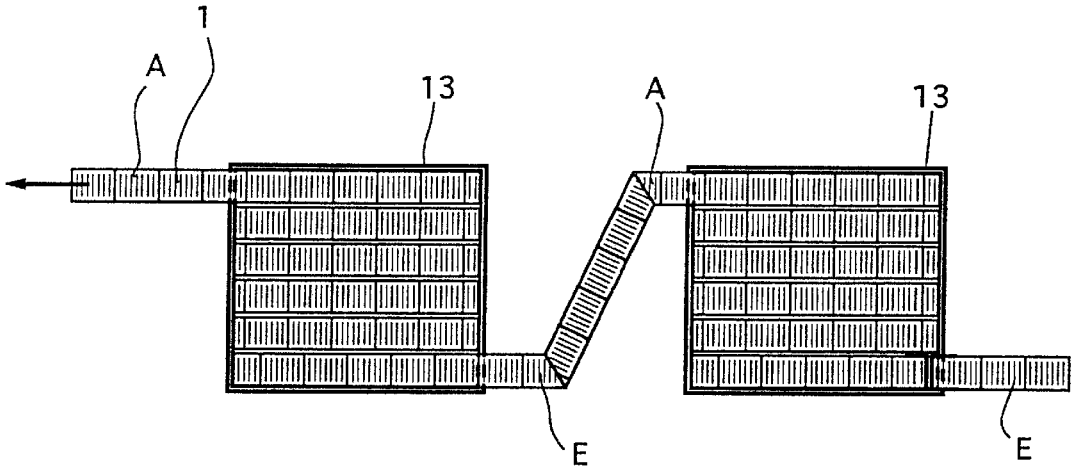
FIGS. 3 and 4 are schematic top plan and sectional side elevation views, respectively, of two webs of bags connected to each other with the webs arranged in containers in the form of a plurality of folded stacks, the side elevation of FIG. 4 being parallel to the folded stacks.
Figure 4:
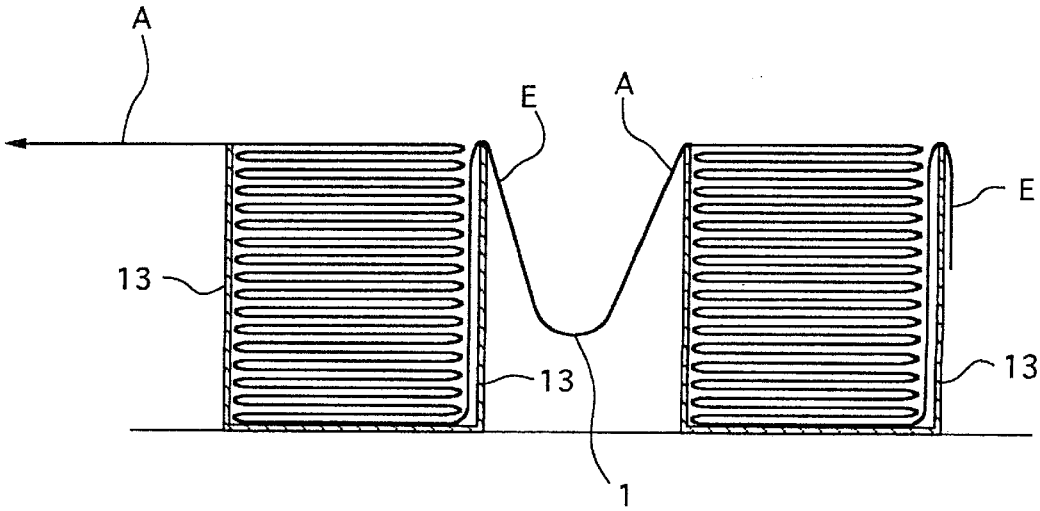

FIGS. 3 and 4 show two parallelepipedic containers 13 each of which is filled with a web of bags, the webs of bags being connected to each other by a connection between the tail end E of the web in one container and the head end A of the web in the next container. FIG. 3 shows the containers in a top view, FIG. 4 in a vertical section parallel to the folded stacks.

FIGS. 5 to 9 show, more in detail, how a plurality of folded stacks as shown in FIGS. 3 and 4, is advantageously arranged in a container 13.

FIG. 5 shows a top view of the filled container. Web 1 of bags forms six juxtaposed folded stacks 20 to 25, wherein the head end A of the web connects to the uppermost layer of stack 20, the head end being shown folded out to the outside of the container. Tail end E of the web is connected to the lowest layer of folded stack 25, and from there is pulled upward inside the container in location 30 on the side of folded stack 25. It is also shown folded out of the container. Between the lowest layer of each stack and the uppermost layer of each adjacent next stack, the web forms a connecting loop V. These loops V are pulled upward inside the containers in locations 31, on the side of the stacks, and lie loosely on the top of the stacks or are, as shown in FIG. 5, folded out to the outside of the container.

FIG. 5 shows container 13 in a condition in which it is ready to be connected to a series of containers. For this reason, the container carries no cover and the two web ends A and E and the connecting loops V are folded out to the outside of the container.

FIGS. 6 to 9 show container 13 according to FIG. 5 in a vertical section according to the corresponding section lines in FIG. 5. FIG. 6 shows folded stack 20 and head end A of the web folded out to the outside of container 13. FIG. 7 shows folded stack 25 with tail end E folded out to the outside of the container and connecting loop V also folded out toward the outside. FIG. 8 shows the same section as FIG. 7, but in which tail end E and connecting loop V lie on top of the folded stack and container 13 is closed with a cover 16. In this condition, the container can be transported or stored.

FIG. 9 shows container 13 according to FIG. 5 in a section perpendicular to the folded stacks. In order to prevent unwanted interaction between a region of the web which is moved by pulling the web of bags out of the container or off one of the folded stacks, respectively, and the layers of the adjacent stack, separating walls 17 are between the folded stacks in the container. These separating walls can be simple pieces of cardboard.

An arrangement of a discrete length of a web of bags in container 13, as illustrated in FIGS. 5 to 9, can easily be set up manually. Thereby, arranging the web is started from tail end E of the web. Tail end E is hung over the container wall in location 30 (FIG. 5) and in this location the web is guided to the container bottom from where folded stack 25 is built up.

Figure 10:
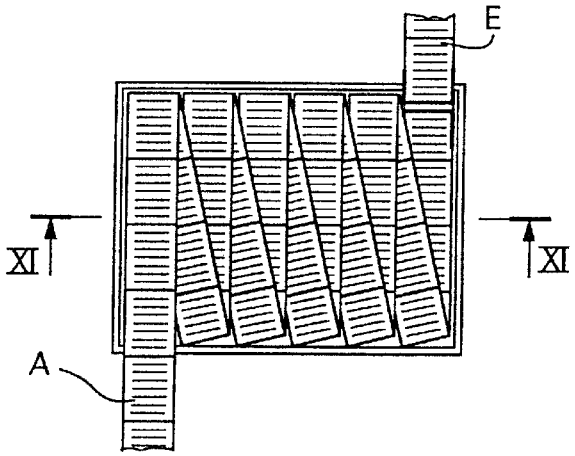
FIGS. 10 and 11 are a schematic top plan and a sectional side elevation along line XI—XI of FIG. 10 of a further arrangement of a web in a container.
Figure 11:
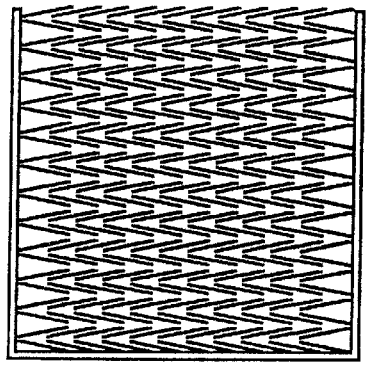

FIGS. 10 and 11 show a further embodiment of an arrangement of a web of bags in a parallelepipedic container to be used in the inventive method. The web is again folded back and forth but, rather than forming upright folded stacks, the webs form layers, each covering the area of the container. The web of bags fills the container in superimposed such layers, each layer covering the whole container area. FIG. 10 shows a top view of the uppermost such layer to which head end A of the web joins on the front left side. Diagonally opposite, tail end E is shown which in this location emerges from the bottom of the container. FIG. 11 shows the container in a vertical section along section line XI—XI of FIG. 10.

Figure 12:
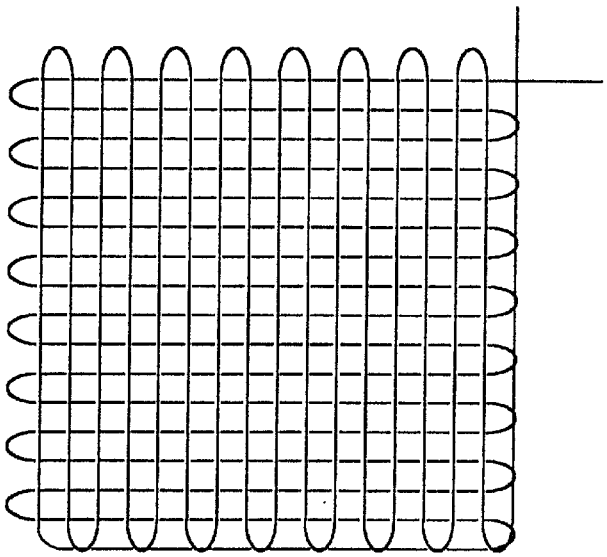
FIGS. 12 and 13 are diagrams showing two further web arrangements.
Figure 13:
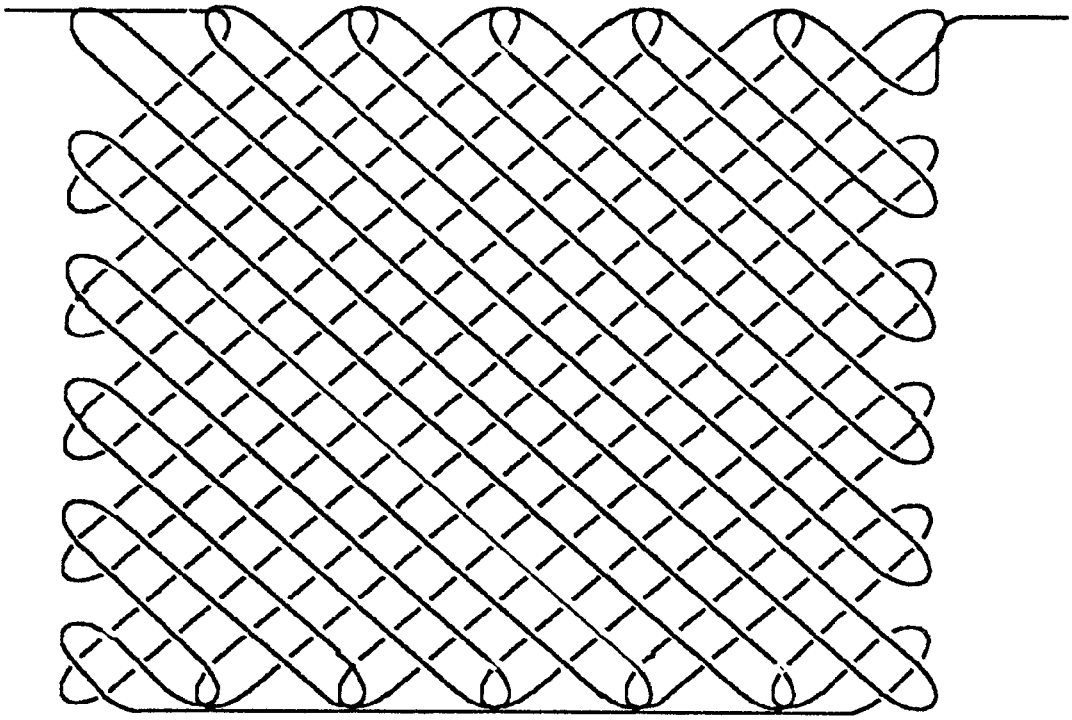

FIGS. 12 and 13 schematically show two further embodiments of arrangements of a web of bags in a container. Each of these figures shows two adjacent folded stacks arranged on top of each other or next to each other in a container, the stacks being viewed from one of the longitudinal edges of the web of bags which is represented by a single line. In both cases, the layers of the adjacent folded stacks are arranged perpendicular to each other (the embodiment according to FIGS. 5 to 9 shows parallel layers in adjacent folded stacks). With this kind of arrangement, it is possible to prevent interference between the region of the web as it is moved by being pulled out and the adjacent stack and it is therefore possible for the web to be drawn from the container in an orderly manner even without separating walls between the stacks.

The layers of folded stacks in FIG. 12 are parallel to the container walls or to the container base, respectively, and the layers of the folded stacks in FIG. 13 are arranged diagonally.

For processing web arrangements according to FIGS. 12 and 13, it may be advantageous to hold the container in an oblique position such that the stacks to be processed later, or the layers of such stacks, are lower down relative to those to be processed earlier.

It will be obvious that the size and the form of the containers may be different from the size and form of the containers as described above and that web arrangements may be combined in different manner than shown in the figures.

What is claimed is:

1. A method of feeding a web of sample bags in a container having a bottom wall, side walls and an openable top side, the web having two longitudinal edges, a width between said longitudinal edges, a head end and a tail end, the method comprising positioning the web in the container in a plurality of juxtaposed, folded stacks in which the width of the web extends parallel with the bottom wall of the container;

positioning the head end of the web at a top of the plurality of stacks;

passing the tail end of the web from a bottom of one of the plurality of stacks, upwardly along one container side wall to a top of the stacks and is positioning the tail end on top of the plurality of stacks;

forming the web in loops between adjacent stacks in the plurality of stacks; the loops being initially positioned on top of the stacks when the container is closed and closing the container removing the web from the container by pulling on the head end and passing the head end to further processing.

2. The method according to claim 1 including attaching the tail end of the web to a head end of a web in a second container, so that the web in the second container is pulled after the web in the first-mentioned container is empty.

3. The method according to claim 1 including inserting separating walls between stacks in the plurality of stacks.

4. A method of feeding a web of sample bags from a container having a bottom wall, side walls and an openable top side, the web having two longitudinal edges, a width between the longitudinal edges, a head end and a tail end, the method comprising positioning the web in the container in a plurality of juxtaposed, folded stacks in which the width of the web extends parallel with the bottom wall of the container or in superimposed folded stacks in which the width of the web is perpendicular to the bottom wall of the container;

positioning the longitudinal edges of the web between folds of one stack of the plurality of stacks so that the edges extend substantially perpendicular to the longitudinal edges of the web between folds of a next adjacent stack;

positioning the head end of the web at a top of the plurality of stacks;

passing the tail end of the web from a bottom of one of the plurality of stacks, upwardly along one of the container side walls to a top of the stacks and is positioned on top of the plurality of stacks, and removing the web from the container by pulling on the head end.

5. The method according to claim 4 including attaching the tail end of the web to a head end of a web in a second container, and pulling the web from said second container after the web in the first-mentioned container is empty.

* * * * *

UNITED STATES PATENT AND TRADEMARK OFFICE

CERTIFICATE OF CORRECTION

PATENT NO. : 6,173,555 B1
DATED : January 16, 2001
INVENTOR(S) : Jaeger et al.

It is certified that error appears in the above-identified patent and that said Letters Patent is hereby corrected as shown below:

Title page,
Item [75] Inventors, Line 2, delete "SE" and insert -- CH --.

Item [30] Foreign Application Priority Data, delete "SE" and insert -- CH --.

Column 1,
Line 8, delete "6,028,819" and insert -- 6,029,819 --.

Column 6, claim 1,
Line 21, before "closing the container", begin new paragraph.
Line 21, after "closing the container", add -- the loops being folded outside of the container before removal of the web from the container; and --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*